United States Patent [19]

Mlyniec

[11] 4,195,209

[45] Mar. 25, 1980

[54] PRESSURE RESPONSIVE ELECTRICAL SWITCH AND MEANS OF CONTACT GAP SETTING THEREFOR

[75] Inventor: Kenneth P. Mlyniec, Lebanon, Ohio

[73] Assignee: Emerson Electric Co., St. Louis, Mo.

[21] Appl. No.: 927,655

[22] Filed: Jul. 24, 1978

[51] Int. Cl.[2] ..... H01H 35/34

[52] U.S. Cl. ..... 200/83 R; 200/83 J

[58] Field of Search ..... 200/81 R, 83 R, 83 J, 200/83 N, 83 V, 83 P

[56] References Cited

U.S. PATENT DOCUMENTS

| | | | |
|---|---|---|---|
| 3,786,210 | 1/1974 | Byam | 200/81.4 |
| 4,038,506 | 7/1977 | Filip | 200/83 J |

*Primary Examiner*—Gerald P. Tolin

*Attorney, Agent, or Firm*—Biebel, French & Nauman

[57] ABSTRACT

A pressure responsive switch for changing electrical state in response to a fluid pressure which equals or exceeds a desired pressure threshold level includes a cylindrical conductive casing. The casing defines a central, generally cylindrical cavity and at least one upper fluid inlet orifice. The casing further defines a lower opening communicating with the cavity. A non-conductive elastic membrane extends across the upper portion of the cavity beneath the fluid inlet orifice and is sealingly attached at its periphery to the interior of the casing. A conductive, pressure actuatable plunger in the upper portion of the cavity includes a pressure receiving surface directly beneath the membrane. An electrical connector is mounted by a bushing means centrally in the cavity. The connector is held out of electrical contact with a casing and has a first end extending out of the cavity through the lower opening in the conductive casing and a second end which is positioned in the cavity. A conductive spring means in the cavity provides an electrical path between the conductive casing and the plunger and applies a predetermined upward force to the plunger, urging the plunger out of contact with the second end of the connector. When the fluid admitted by the fluid inlet orifice reaches the desired pressure threshold level, the plunger will be moved downward by the fluid pressure against the force of the spring means, such that the plunger will contact the second end of the connector and provide an electrical path between the connector and the casing. The second end of the connector and the plunger thus define first and second switch contact means.

7 Claims, 6 Drawing Figures

PRESSURE RESPONSIVE ELECTRICAL SWITCH AND MEANS OF CONTACT GAP SETTING THEREFOR

BACKGROUND OF THE INVENTION

The present invention is directed to a pressure sensitive switch and, more particularly, to a switch for completing an electrical circuit when a desired fluid pressure level is reached and to a method of setting the switch contact gap.

Various pressure sensing electrical switch arrangements have been used in the past to detect when the pressure of a fluid equals or exceeds a predetermined pressure level. Many switches of this type have a coil spring which opposes the force exerted by the fluid on a piston. When the pressure of the fluid exerts a sufficient force, the piston is moved and ultimately causes electrical contacts to make or break an electrical circuit.

One type of pressure responsive switch arrangement for determining the pressure of a fluid within specified pressure ranges is shown in U.S. Pat. No. 3,786,210, issued Jan. 15, 1974, to Bayam. In the Bayam reference, three switches having springs which differ in spring constant, are provided. Each of the pressure sensitive switches receives pressurized fluid through a separate opening in a covering plate. Each switch is actuatable at a different pressure and has a metal piston which is spring based toward the covering plate. Current is supplied to each piston by means of its associated compression spring. When actuated, the piston of a switch will have been moved against the opposing force of the compression spring so as to contact the metallic casing. A separate resistance is in series with each compression spring and all three resistances are connected to a single electrical connector. It is possible, therefore, to determine the pressure of the fluid, within the ranges specified, by measuring the value of resistance connected between the single connector and the conductive portion of the casing.

Another type of pressure sensitive switch is shown in U.S. Pat. No. 3,573,410, issued Apr. 6, 1971, to Budzich et al. A non-conductive piston in the device of Budzich actuates a bistable snap element upon which are mounted the electrical contacts for the switch. In the Budzich et al device, the pressure level for actuation is determined by the spring constant of a coil spring opposing the motion of the piston. Additionally, this spring carries current in the electrical switch circuit when this circuit is closed.

In U.S. Pat. No. 3,622,976, issued Nov. 23, 1971, to Howard, a pressure sensitive switch is disclosed which includes a spring biased plunger. The plunger normally completes an electrical circuit between a terminal connected to the biasing spring and a conductive portion of the switch case. When sufficient force is applied to the plunger, it is moved against the biasing force of the spring, thus breaking the circuit and indicating the pressure level of the fluid being monitored.

The gap between the electrical contacts in such a switch has, in the past, generally been set by maintaining the dimensional stability of the elements which form the switch. It is desirable to provide a small gap between the contacts such that the movement of the switch elements is minimized and wear on the moving parts, particularly the membrane at the fluid inlet, is reduced. It will be appreciated, however, that setting an especially small contact gap in such a switch requires that the switch elements be manufactured to close tolerances and that this, in turn, adds significantly to the cost of the switch.

There is a need for a simple pressure sensitive switch which is of economical design and which is reliable in operation and for an improved method of setting the contact gap in such a switch.

SUMMARY OF THE INVENTION

A pressure responsive switch for changing electrical switching states in response to a fluid pressure which equals or exceeds a desired pressure threshold level includes a cylindrical conductive casing having a central, generally cylindrical cavity. Means define at least one upper fluid inlet orifice in the casing communicating with the cylindrical cavity. Means also define a lower opening in the casing communicating with the cavity.

A non-conductive elastic membrane extends across the upper portion of the cavity beneath the fluid inlet orifice and is sealingly attached at its periphery to the interior of the casing. A conductive, pressure actuatable plunger in the upper portion of the cavity, includes a pressure receiving surface directly beneath the membrane. An electrical connector is mounted by a bushing means centrally in the cavity and out of electrical contact with the casing. The connector is mounted such that a first end extends out of the cavity through the lower opening in the conductive casing and a second end is positioned in the cavity.

A conductive spring means in the cavity provides an electrical path between the conductive casing and the plunger and applies a predetermined upward force to the plunger, urging the plunger out of contact with the second end of the connector. When the fluid admitted by the fluid inlet orifice reaches the desired pressure threshold level, the plunger will be moved downward by the fluid pressure, against the force of the spring means, such that the plunger will contact the second end of the connector and provide an electrical path between the connector and the casing. The second end of the connector and the plunger thus define first and second switch contact means, respectively.

The spring means may comprise a compression spring, having a first end contacting the plunger, and a conductive washer in the lower opening, surrounding the bushing means, and providing electrical contact between the casing and the second end of the compression spring. The pressure responsive switch may further include an annular bushing in the cavity surrounding the plunger and the compression spring and defining a central opening within which the plunger moves. The conductive washer may engage the bushing means. The casing adjacent the lower opening may be crimped inwardly to engage positively the periphery of the conductive washer between the annular bushing and the crimped portion of the casing.

The plunger may further include an electrical contact for contacting the second end of the electrical connector as the plunger is moved downward by the pressure of the fluid admitted by the fluid inlet orifice.

The method of setting the contact gap between the first and second switch contact means includes the step of applying a force to the exterior of the casing means sufficient to move a portion of the casing means to a distorted position in which the second switch contact means makes electrical contact with the first switch contact means. The force is then removed from the exterior of the casing means to permit the portion of the casing means to rebound away from its distorted position into a final position in which the second switch means defines the contact gap with the first switch contact means.

Accordingly, it is an object of the present invention to provide a simple, reliable, and economical pressure sensitive switch; and, to provide such a switch in which an electrical circuit is completed when a fluid pressure level equals or exceeds a desired pressure threshold level.

Other objects and advantages of the invention will be apparent from the following description, the accompanying drawings and the appended claims.

DETAILED DESCRIPTION OF THE PREFERRED EMBODIMENT

Figure 1:
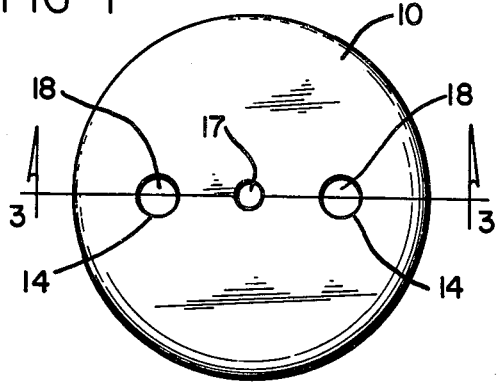
FIG. 1 is a plan view of the pressure responsive switch of the present invention.
Figure 2:
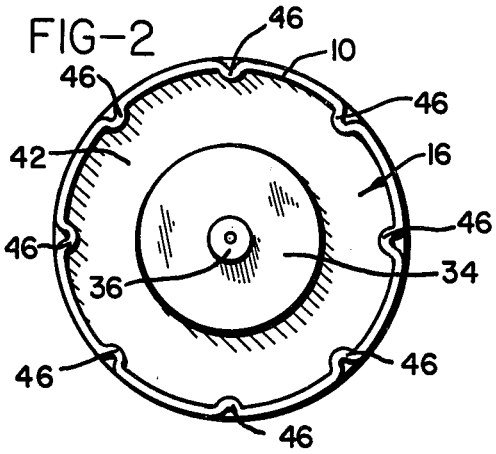
FIG. 2 is a view of the switch as seen from below.
Figure 3:
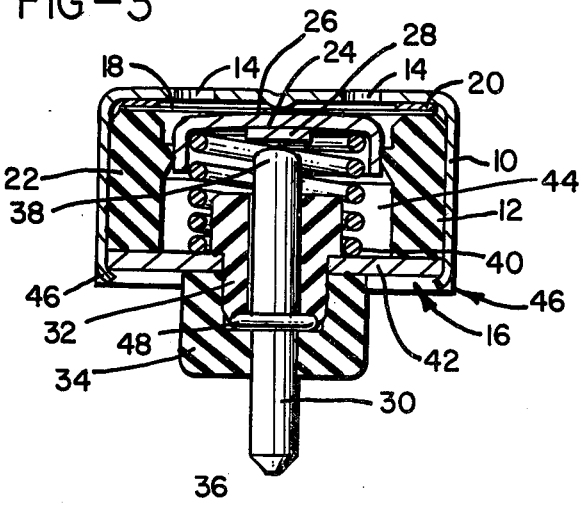
FIG. 3 is a sectional view, taken generally along line 3—3 in FIG. 1, showing the switch elements prior to actuation.

Reference is now made to FIGS. 1-3, showing the pressure responsive switch of the present invention. FIG. 3 is a sectional view taken generally along 3—3 in FIG. 1, showing the elements of the switch prior to actuation. The switch elements will remain in the positions shown until the pressure of the fluid being monitored equals or exceeds a desired pressure threshold level.

The switch includes a cylindrical conductive casing 10 having a generally cylindrical cavity 12 therein. The casing defines upper fluid inlet orifices 14, communicating with cavity 12, and a lower opening 16 which also communicates with cavity 12. A position limiting boss 17 is defined by the casing, the purpose of which is described below. A non-conductive elastic membrane 18 extends across the upper portion of the cavity 12 beneath the fluid inlet orifices 14 and is sealingly attached at its periphery to the interior of the casing between rubber gasket 20 and annular bushing 22.

A conductive, pressure actuatable plunger 24 in the upper portion of cavity 12 includes a pressure receiving surface 26 directly beneath the membrane 18. Attached to the bottom of plunger 24 is an electrical contact 28. An electrical connector 30 is mounted by a bushing means including bushings 32 and 34. The connector 30 is mounted centrally in cavity 12 and is held out of electrical contact with the casing 10. A first end 36 of connector 30 extends out of the cavity 12 through the lower opening 16 in the casing 10. A second end 38 of connector 30 is positioned in cavity 12.

A conductive spring means in cavity 12 provides an electrical path between the conductive casing 10 and the plunger 24 and includes compression spring 40. The spring means applies a predetermined upward force to the plunger 24 which urges the plunger out of contact with the second end 38 of connector 30. The predetermined upward force is set by using a spring having a desired spring constant and is chosen such that switch actuation at the desired pressure threshold level is achieved. The conductive spring means also includes a conductive washer 42 which is positioned in the lower opening 16 of casing 10. The compression spring 40 contacts the plunger 24 at a first end and the washer 42 at a second end. The conductive washer 42 provides an electrically conductive path between the casing 10 and the second end of the compression spring 40.

Annular bushing 22 is positioned in cavity 12 such that it surrounds the plunger 24 and the spring 40. Bushing 22 defines a central opening 44 within which the plunger 24 moves. Casing 10 is crimped inwardly at points 46 adjacent said lower opening 16 and thereby positively engages the periphery of the conductive washer 42 between the annular bushing 22 and the crimped portion of the casing 10. The conductive washer 42 engages bushings 32 and 34 which may advantageously be formed of a thermoplastic polyester. Ridge 48 around connector 30 and washer 42 are held between the bushings 32 and 34 which are ultrasonically welded together along their contacting surfaces.

Figure 4:
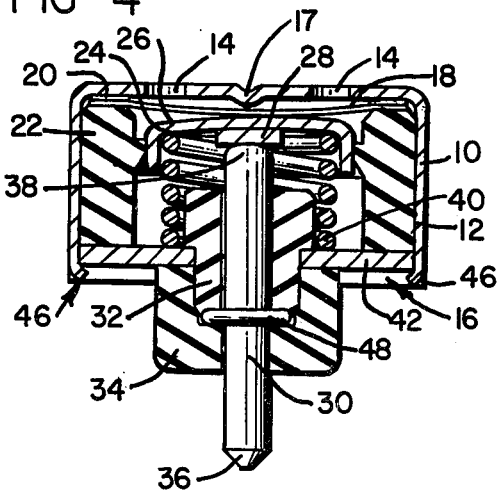
FIG. 4 is a view similar to that of FIG. 3, but showing the switch elements after actuation of the switch.

Reference is now made to FIG. 4, illustrating the pressure responsive switch of the present invention after actuation in which the plunger 24 is moved downward by the pressure of the fluid admitted through the fluid inlet orifices 14. As seen in FIG. 4, when the plunger 24 is in a first position, an electrical path is completed from the casing 10 to the electrical connector 30 via the washer 42, the spring 40, and the plunger 24, including electrical contact 28. When the plunger 24 is in a second position in which it abuts the casing means, the electrical path is broken and the contact gap is defined between the end 38 of connector 30, comprising a first switch contact means, and the plunger 24, comprising the second switch contact means.

It will be appreciated that the constructon of the switch of the present invention facilitates switch assembly, since the elements comprising the switch, when inserted into the casing 10 in the correct sequence, are self-centering.

Figure 5:
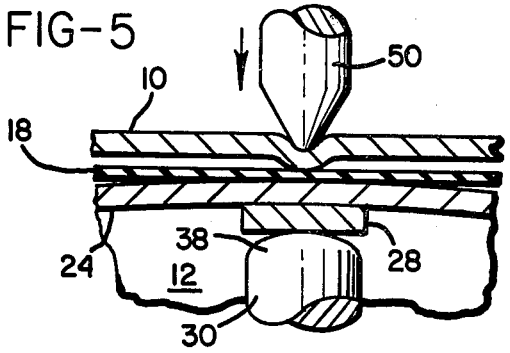
FIGS. 5 and 6 are enlarged partial sectional views, taken generally along line 3—3, illustrating the manner in which the contact gap is set in the present invention.
Figure 6:
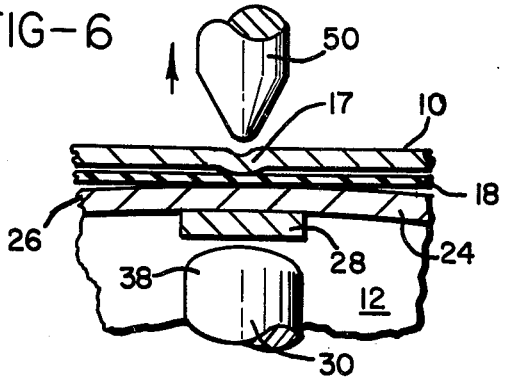

The contact gap between the end 38 of connector 30 and the electrical contact 28 is slightly exaggerated in the drawings for the sake of clarity. This gap is set in the following manner. After the switch has been fully assembled, the contact gap is $0.02 \pm 0.005$ in. A force is then applied to the exterior of the casing means including casing 10 and membrane 18 which is sufficient to move a portion of the casing means to a distorted position, as shown in FIG. 5, in which the second switch contact means including plunger 24 makes electrical contact with the first switch contact means, including connector 30. A hard, generally conical tool 50 may be used for this purpose. The force is then removed from the exterior of the casing means, as shown in FIG. 6, to permit this portion of the casing means to rebound away from its distorted position into a final position in which the second switch contact means, including plunger 24, is held in its second position, abutting the casing means, and defining the contact gap with the first switch contact means.

The rebound of the casing means will be such that casing 10 will define position limiting boss which abuts the plunger 24 through membrane 18. The contact gap after the setting operation of FIGS. 5 and 6 will be $0.01 \pm 0.002$ in. It will be appreciated that the amount of rebound exhibited by the casing will be a function of a number of factors, including the casing material and its thickness. In the illustrated switch, the casing is formed of 0.025 in. thick low carbon steel such as a 10—10 or 10—08 steel. It has been found, however, that the duration of the application of force to the casing means has little effect upon the amount of rebound.

The distance by which plunger 24 can be moved is limited to the dimension of the gap. By setting the gap to a minimum, it will be appreciated that the travel of plunger 24 and, therefore, the travel of the membrane 18 will be reduced. This will significantly increase the life expectancy of the membrane.

While the form of apparatus herein described constitutes a preferred embodiment of the invention, it is to be understood that the invention is not limited to this precise form and that changes may be made therein without departing from the scope of the invention.

What is claimed is:

1. A pressure responsive switch for changing electrical switching state in response to a fluid pressure which equals or exceeds a desired pressure threshold level, comprising:

a cylindrical conductive casing having a central, generally cylindrical cavity and defining at least one upper fluid inlet orifice communicating with said cavity, said casing defining a position limiting boss extending downward adjacent said inlet orifice into said cavity, and said casing further defining a lower opening communicating with said cavity, a nonconductive elastic membrane extending across the upper portion of said cavity beneath said fluid inlet orifice and said position limiting boss, and sealingly attached at its periphery to the interior of said casing, a conductive, pressure actuatable plunger in the upper portion of said cavity including a pressure receiving surface directly beneath said membrane, an electrical connector, means mounting said electrical connector centrally in said cavity out of electrical contact with said casing such that a first end of said connector extends out of said cavity through said lower opening in said conductive casing and a second end of said connector is positioned in said cavity, and means in said cavity providing an electrical path between said conductive casing and said plunger and applying a predetermined upward spring force to said plunger urging said plunger out of contact with said second end of said connector, the upward movement of said plunger and said membrane being limited by said position limiting boss, whereby when the fluid admitted by said fluid inlet orifice reaches the desired pressure threshold level, said plunger is moved downward by the fluid pressure against said spring force such that said plunger contacts said second end of said connector and provide an electrical path between said connector and said casing.

2. The pressure responsive switch of claim 1 in which said means in said cavity providing an electrical path between said conductive casing and said plunger and applying a predetermined upward spring force to said plunger, comprises a compression spring having a first end contacting said plunger.

3. The pressure responsive switch of claim 2 in which said means in said cavity providing an electrical path between said conductive casing and said plunger and applying a predetermined upward spring force to said plunger, further comprising a conductive washer in said lower opening, surrounding said means mounting said electrical connector, and providing electrical contact between said casing and the second end of said compression spring.

4. The pressure responsive switch of claim 3 further comprising an annular bushing in said cavity, surrounding said plunger and said compression spring, and defining a central opening within which said plunger moves.

5. The pressure responsive switch of claim 4 in which said conductive washer engages said means mounting said electrical connector and in which said casing adjacent said lower opening is crimped inwardly, thereby positively engaging the periphery of said conductive washer between said annular bushing and the crimped portion of said casing.

6. The pressure responsive switch of claim 5 in which a rubber gasket is positioned adjacent the periphery of said membrane, and said membrane and said gasket are held between said annular bushing and said casing to provide a fluid seal around the periphery of said membrane.

7. The pressure responsive switch of claim 1 in which said conductive, pressure actuatable plunger includes an electrical contact for contacting said second end of said electrical connector as said plunger is moved downward by the pressure of the fluid admitted by the fluid inlet orifice.

* * * * *